US005243902A

United States Patent [19]

Plazenet

[11] Patent Number: 5,243,902

[45] Date of Patent: Sep. 14, 1993

[54] HYDRAULIC BENDING PRESS WITH MOVABLE LOWER PLATEN

[75] Inventor: Jean Plazenet, LaVarenne Saint Hilaire, France

[73] Assignee: Amada Co., Kanagawa, Japan

[21] Appl. No.: 752,506

[22] PCT Filed: Dec. 18, 1990

[86] PCT No.: PCT/FR90/00918

§ 371 Date: Aug. 19, 1991

§ 102(e) Date: Aug. 19, 1991

[87] PCT Pub. No.: WO91/08894

PCT Pub. Date: Jun. 27, 1991

[30] Foreign Application Priority Data

Dec. 19, 1989 [FR] France ..... 89 16778

[51] Int. Cl.[5] ..... B30B 15/24

[52] U.S. Cl. ..... 100/46; 100/258 A; 72/389

[58] Field of Search ..... 100/46, 258 A; 72/389, 72/465

[56] References Cited

U.S. PATENT DOCUMENTS

| | | | |
|---|---|---|---|
| 3,129,625 | 4/1964 | Jones, Jr. | 100/258 A |
| 3,550,425 | 12/1970 | Cailloux | 100/258 A |
| 3,668,919 | 6/1972 | Hongo | 72/389 |
| 4,148,203 | 4/1979 | Farazandeh et al. | 100/46 |
| 4,366,699 | 1/1983 | Tsuchiyama | 72/389 |
| 4,656,862 | 4/1987 | Kogure et al. | 72/389 |
| 4,784,058 | 11/1988 | Nakagawa et al. | 100/46 |
| 4,819,467 | 4/1989 | Graf et al. | 72/389 |
| 4,828,474 | 5/1989 | Ballantyne | 100/46 |
| 4,923,383 | 5/1990 | Kurumaji et al. | 100/46 |

FOREIGN PATENT DOCUMENTS

| | | | |
|---|---|---|---|
| 1362471 | 9/1964 | France . | |
| 0022109 | 2/1984 | Japan | 100/46 |

*Primary Examiner*—Harvey C. Hornsby
*Assistant Examiner*—Reginald L. Alexander
*Attorney, Agent, or Firm*—Young & Thompson

[57] ABSTRACT

A bending press is equipped with a movable lower platen actuated by at least three hydraulic jacks, two of which are placed at the lateral ends of the movable platen and at least one of which is placed at the center along the axis of the platen. The hydraulic circuit is associated with a device for detecting the presence of any tilting torque on the movable platen, and with a comparator and computer system connected to the detection device. The jacks are connected to a common directional distributor via pressure control units controlled by the comparator and computer system. This system is capable of producing a continuous reduction in pressure exerted on the jack located on the side opposite to the direction of the tilting torque and possibly also on the jack located at the center so as to produce a torque in opposition to the tilting torque.

2 Claims, 3 Drawing Sheets

HYDRAULIC BENDING PRESS WITH MOVABLE LOWER PLATEN

BACKGROUND OF THE INVENTION

1. Field of the Invention

The present invention relates to hydraulic bending presses for deformation of sheet metal parts.

More specifically, the invention is concerned with bending presses of the type comprising a stationary upper platen and a movable lower platen actuated by at least three hydraulic jacks, two of which are placed at the lateral ends of the movable platen and at least one of which is placed at the center, these jacks being supplied from a single directional distribution system which controls the upward and downward movements of the movable platen.

2. Description of the Prior Art

Machines of this type have an advantage in that parallel deformation of the opposite edges of the two platens takes place during operation of the press by virtue of the fact that the thrust force exerted by the jacks on the movable lower platen is uniformly distributed along this movable platen in order to form constant and accurate folding angles. This machine geometry is that of machines described in French patent No. 1,362,471. In these machines, guiding means are provided for maintaining the movable platen parallel to the stationary upper platen during its displacements. As a rule, these guide means consist of rotating rollers carried by the movable platen and placed in contact with guide tracks provided on stationary elements of the frame. However, these mechanical guiding means prove to be insufficient in the event that the resultant of the forces generated by the work performed is not located in the axis of the machine. In such a case, the movable platen is in fact subjected to a tilting torque. Under these conditions, by reason of the elasticity of the different parts of the machine as well as the elasticity of the guiding means themselves, these means prove to be incapable of maintaining either general parallelism or parallelism of the opposite edges of the two platens as is required for ensuring angular precision along the entire length of the bend.

The problem of balancing of presses subjected to an eccentric work force has been a matter of concern to both manufacturers and users, whether in the case of plate-type presses for general use or bending presses having a long and narrow platen in which this problem is particularly critical.

The machine to which the invention applies in accordance with the present Application is of a very special type. In fact, it involves the use of a single pressure source, a single distribution for control of movements and at least three working jacks, at least one of which is placed at the center.

The different methods of balancing which have already been developed do not apply to this type of machine and to this configuration of elements. Even in the field of machines to which they do apply, they fail to obtain both a general parallel relationship or parallelism between the two platens and optimization of the parallelism of the opposite faces of the lower and upper platens as is exhibited by the machines in accordance with French patent No. 1,362,471 on condition that the load is centered, that is to say the parallelism which takes into account geometrical deformations of the platens under the action of work forces.

The techniques employed up to the present time are usually concerned with presses having two upper jacks and involve the use of a machine equipped with a unit for servo-distribution by means of a jack. In arrangements of this type, the pressure established within the jack is solely a function of the work reaction which takes place in opposition to the movement of the jack, the servo-distributor being intended to control a volume of oil supplied to the jack.

In devices equipped with two jacks, by reason of the very fact that the number of jacks is limited to two, the basic characteristic of parallel sag of the opposite platen faces, even under centered load conditions, cannot be realized as in the presses in accordance with French patent No. 1,362,471 which describes a technique involving the use of three jacks. Only general parallelism is ensured in all presses having two jacks and two servo-distributors.

When the load is off-center, these presses equipped with a device having two servo-distributors are subject to a disadvantage in that they are not always capable of controlling the deformations of the opposite faces.

Under eccentric load conditions, the use of servo-distribution control devices of the same type in a three-jack press would not make it easier to control the parallelism of deformation of the opposite edges. In fact, the pressure established within each jack is a function solely of the work force applied opposite to this jack. Under these conditions, there is no way of producing deliberate action on these pressures and therefore on the deformations.

U.S. Pat. No. 2,343,167 offers a different approach to the transmission of eccentric forces. In this patent, the general parallelism of the movable work platen is controlled in dependence on the position of a movable reference element. Since this reference element is not subjected to any work force, it completely sets aside the concept of parallel sags. Moreover, the hydraulic balancing device calls for a variable-throttling element which is preset by the operator during preliminary tests and is therefore not automatically adapted to requirements in order to overcome the eccentric load displacement. Aside from the fact that a pressure-limiting device has no effect in the static stage, that is to say in the stage of maintenance of pressure at the end of the working stroke which is an essential stage for the quality of shaping work, preadjustment is an all-or-none adjustment operation controlled by microswitches. These devices make it possible only to avoid roughly and non-automatically the major disturbances associated with an eccentric work force but in no way permit fine and automatic correction as is necessary in a hydraulic bending press.

The device described in French patent No. 2,545,418 is basically concerned with a search for optimization of parallelism of the opposite faces of the platens and clearly demonstrates the importance of optimization. In order to obtain this result, French patent No. 2,545,418 makes use of additional bearing points for one of the platens carried by auxiliary cross-members, in the same manner as French patent No. 2,347,992, and adds one or a number of supplementary jacks for bowing the other platen, the jacks themselves being carried by auxiliary cross-members.

These devices entail the need for a complex machine structure comprising three steel plates for constituting the stationary platen, three steel plates for constituting the movable platen, additional bearing points constituted by heavy steel pins and one or a number of additional jacks. This technique is cumbersome and costly. In addition, it is far removed from the geometry of machines of the type provided with a movable lower platen as described, for example, in French patent No. 1,362,471.

In the present state of the art, there does not exist any approach which makes it possible in machines having a minimum of three jacks to ensure at the same time general parallelism of the platens and optimization of parallelism of the opposite faces, whether the machine operates in a centered and/or eccentric load condition.

The present Application relates to a hydraulic circuit which makes it possible, while retaining this basic configuration of bending machines, to maintain general parallelism of the upper and lower platens as well as optimization of parallelism of the opposite faces of said platens, this being achieved under either centered or eccentric load conditions.

The object of the invention is to control the force exerted by each jack which produces action on the movable platen on the one hand in order to ensure general parallelism and on the other hand, by producing action on the force applied by each jack in respect of the same value of opposing torque, in order to generate a curve of deformation of the movable lower platen, thus ensuring optimum parallel deformation of the two platens.

SUMMARY OF THE INVENTION

The object of the invention is to provide a bending press for deformation of metals in sheet form, comprising a stationary upper platen and a movable lower platen actuated by at least three hydraulic jacks, two of which are placed at the lateral ends of the movable platen and at least one of which is placed at the center along the axis of said movable platen, the jacks being supplied from a hydraulic circuit provided with a pump driven by a motor, a directional distributor for controlling the upward and downward movements of the movable platen, a device for detecting the presence of any tilting torque on the movable platen, and a comparator and computer system connected to the detection device and having outputs for controlling a regulating system as a function of the detected tilting torque.

According to the invention, all the jacks are connected to a common directional distributor via pressure control units controlled by the comparator and computer system. This system is capable of producing a continuous reduction of the pressure exerted on the jack located on the side opposite to the direction of the tilting torque and possibly also on the jack located at the center so as to produce an opposing torque as a function of the data received from the detection device. This opposing torque is capable on the one hand of counterbalancing the tilting torque in a continuous and proportional manner, thus guaranteeing general parallelism, and on the other hand of ensuring a constant parallel relationship between the work zones of the opposite edges of the platens which undergo deformation during a bending operation.

The means provided for carrying out a pressure control operation on one or a number of the jacks which actuate the movable lower platen can give rise to different forms of construction. Similarly, the device for detecting any tilting displacement of the movable platen as well as the comparator and computer device can be constructed in accordance with a number of different designs.

Thus the invention is distinguished by a number of other features which are summarized below : the computer and comparator system has in addition an input for the entry of additional data defining variations in the general work conditions, the opposing torque being a function of a synthesis of the data received from the detection device and of those entered via the input, the pressure control units comprise a number of proportional pressure reducers corresponding to the number of jacks which actuate the movable lower platen and each reducer is associated with a single jack, the pressure control units each have a single proportional pressure reducer inserted in the hydraulic control circuit and connected to each hydraulic jack via a respective connecting valve adapted to apply to the corresponding jack either the normal pressure of the control circuit or a reduced pressure, the comparator system being capable in addition of producing action on either of these valves or on a number of valves as the case may be.

A certain number of the forms of construction mentioned above are described hereinafter solely by way of example, reference being made to the accompanying drawings.

DETAILED DESCRIPTION OF THE INVENTION

Figure 1:
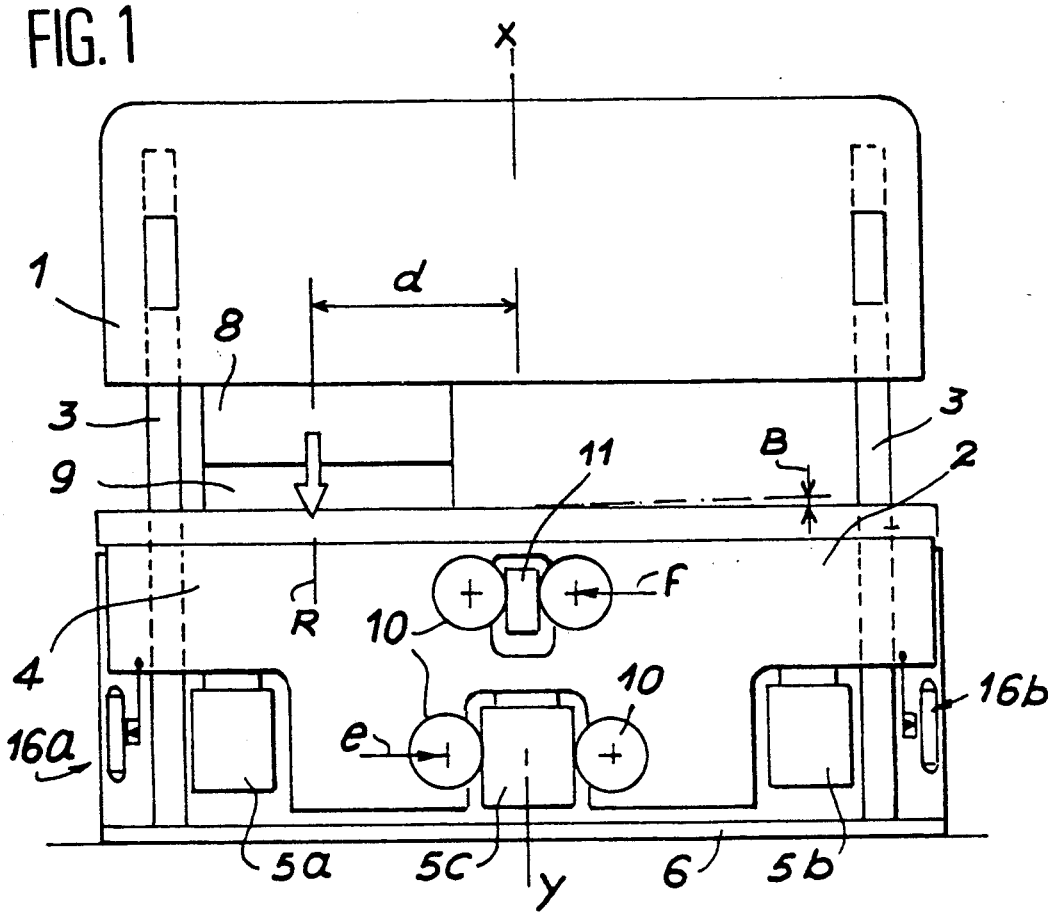
FIG. 1 is a schematic view in front elevation showing a bending press in accordance with the invention.
Figure 2:
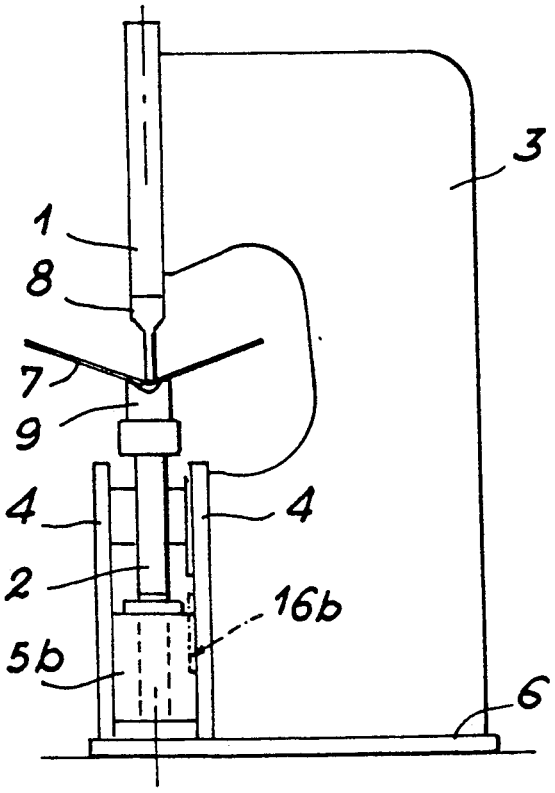
FIG. 2 is a view in end elevation.

The bending press shown in FIGS. 1 and 2 is of the type comprising a stationary upper platen 1 and a movable lower platen 2. The upper platen is carried by a frame having two transverse end-plates 3. The lower platen 2 is mounted between two force transmission cross-members consisting of vertical panels 4 which form part of the frame.

In the example which is illustrated, the platen 2 is actuated by three single-acting hydraulic jacks disposed symmetrically with respect to the median vertical axis X-Y of the machine. Two of these jacks 5*a* and 5*b* are placed near each end of the platen 2. So far as the third jack 5*c* is concerned, it is placed at the center along the axis X-Y. The jacks are supported on the vertical panels 4 of the frame of the machine and are intended to carry out the vertical displacements of the platen 2 and to apply the requisite upward work force on the platen at the time of bending of a metal sheet 7 between two tools adapted to the press, namely a punch 8 carried by the stationary upper platen 1 and a die 9 carried by the movable lower platen 2.

The lower platen is guided by four pairs of rollers 10 mounted to rotate freely on the platen and placed in contact with vertical guide tracks provided respectively on a stationary spacer member 11 rigidly fixed to the cross-members 4 of the frame and on the stationary body of the central jack.

Figure 3:
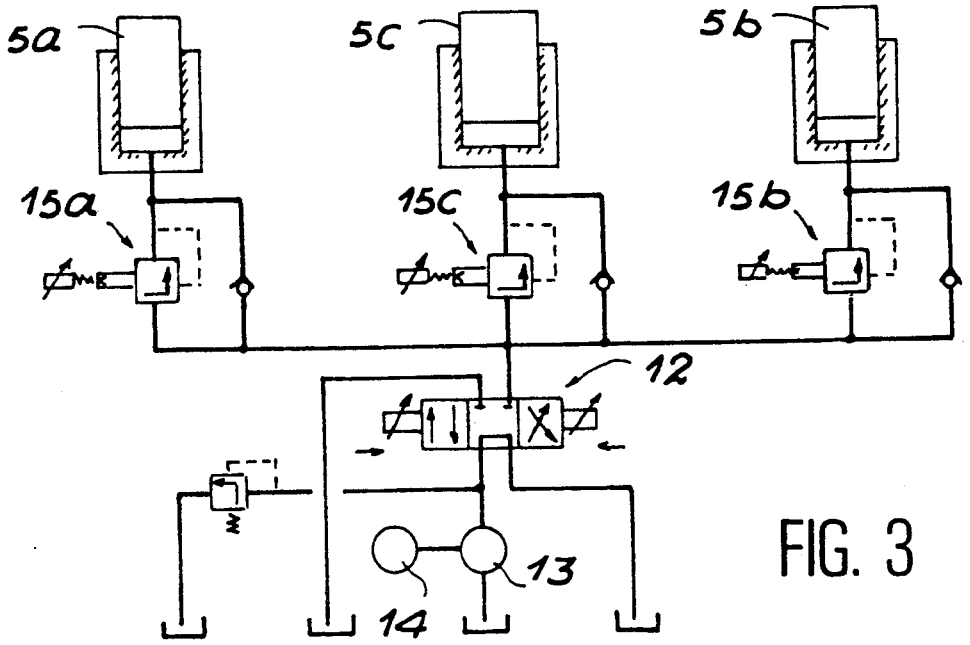
FIGS. 3 and 4 illustrate two different forms of construction of the hydraulic control circuit of the bending press in accordance with the invention.

The three jacks 5*a*, 5*b*, 5*c* are supplied from a directional distributor 12 as can be observed in the diagram of the hydraulic control circuit shown in FIG. 3. This circuit also includes a pump 13 driven by a motor 14. The displacement of the slide-valve of the distributor 12 in one direction or in the other permits upward or downward displacement of the lower platen 2, this last-mentioned displacement being carried out under the action of the weight of the platen.

In accordance with one of the distinctive features of the invention, the present hydraulic circuit further includes pressure control units in the form of proportional pressure reducers 15*a*, 15*b* and 15*c* equal in number to the working jacks of the movable platen. Each of these pressure reducers is associated with one of these jacks as shown in the diagram of FIG. 3. In consequence, by producing action on one or both pressure reducers, the control pressure of the corresponding jack or jacks can be continuously reduced.

A detection device is also provided for detecting any possible tilting motion of the movable lower portion 2 while the press is in use. However, this device is so designed as to be capable of detecting the appearance of any such tilting motion as well as the direction of this motion.

In the example shown in FIGS. 1 and 2, the detection device thus provided is made up of two linear displacement transducers provided at both ends of the lower platen 2. These transducers, designated by the general references 16*a* and 16*b*, can be optical-reading digital transducers or analog transducers of the inductive type, potentiometric type or the like.

Figure 5:
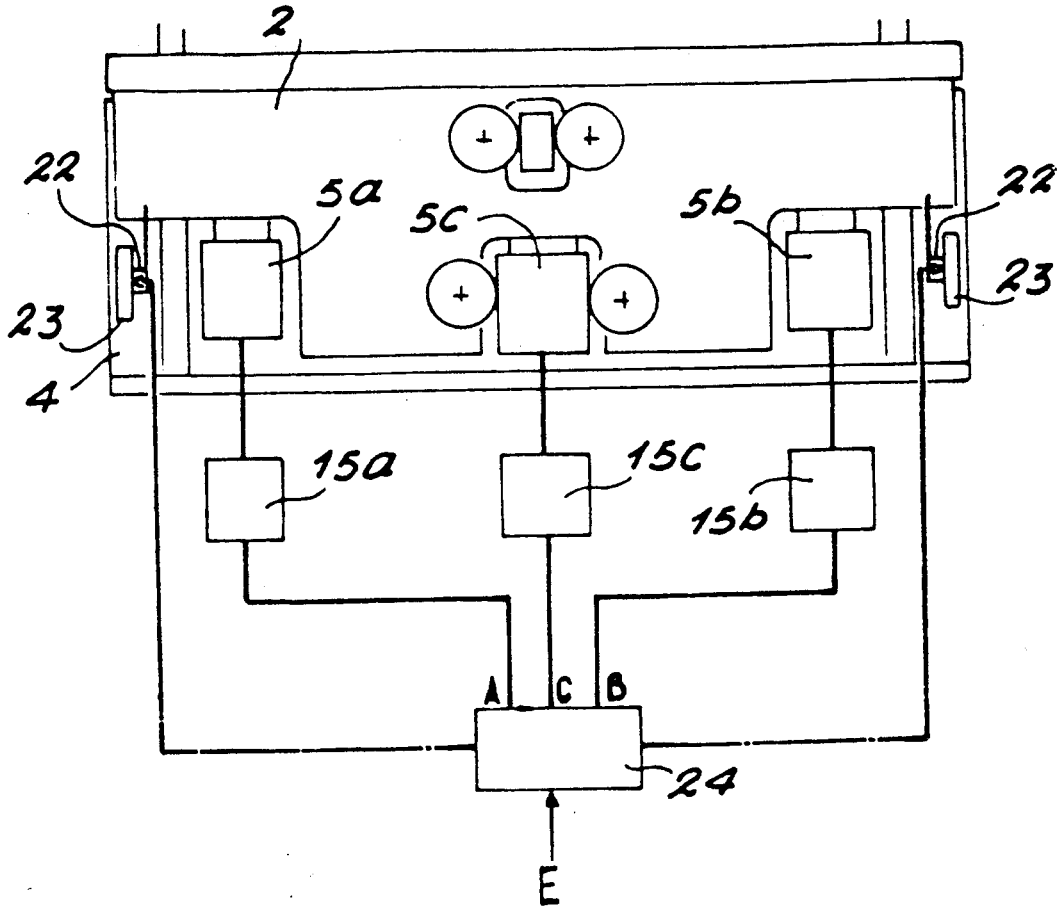
FIG. 5 is a diagram of the control circuit for the pressure reducers provided in the hydraulic circuit in the event that detection of tilting is carried out by measuring the distances of travel of the two ends of the lower platen, then by computing the difference which represents the tilt.

In the example illustrated in FIG. 5, each transducer has a movable index 22 carried by the platen 2 and capable of moving opposite to a stationary vertical rule 23 which is rigidly fixed to one of the cross-members 4 of the frame, or conversely. Thus each transducer is capable of measuring the range of displacement of the corresponding end of the movable platen 2.

The two transducers just mentioned are each capable of transmitting an electric signal which is a function of the measured range of displacement. These two transducers are connected into an electronic circuit comprising a comparator and computer system 24 to which they are connected (as shown in FIG. 5) and which has power outputs A, B and C connected to the control elements of the reducers 15*a*, 15*b*, 15*c*.

The comparator/computer is capable of determining whether there is identity of displacement or whether there exists on the contrary a difference corresponding to a tilting movement of the lower platen 2. Accordingly, the comparator is capable of determining both the magnitude of the tilting torque and the direction of torque.

Furthermore, the comparator and computer 24 has an input E through which are entered the data defining the general work conditions. This instruction can be carried out at the time of programming if the acquisition of data is entirely manual as is usually the case in a numerical control system and/or at the beginning of the work operation if acquisition of data is obtained by a sensing probe system, microswitches or any other form of detectors for detecting the presence of sheet metal or of stress zones such as strain gages.

The work conditions differ in the nominal position of the sheet metal part, namely the position which does not take positioning errors into account, in its length, its thickness and the type of tooling employed. It should be considered that these data form part of those usually communicated to the numerical control of the bending press when it is equipped with such a system. In this case, a single data transfer takes place via the input E from the numerical control. Bending can be normal, centered with a simple possibility of accidental displacement off-center and can be partly off-center or involve operations of different kinds such as bending, punching or die-stamping, and so on. These operations can be performed on tooling units which may be highly off-center in certain instances.

The deformations of the platens are essentially dependent on the nature of these work conditions. It is for this reason that the comparator and computer have to take into account the data delivered to the input E in addition to those received from the transducers 16*a* and 16*b* in order to compute the magnitude of the signals delivered to the outputs A, B, C and transmitted to the reducers 15*a*, 15*b*, 15*c* respectively to the reducer 15 and to the connecting valves 21*a*, 21*b*, 21*c* in accordance with an embodiment described with reference to FIG. 4.

These orders can be in particular either regulated supply of the output A alone or differentiated supply of the outputs A and C for tilting motion in one direction, or regulated supply of the output B alone or differentiated supply of the outputs B and C for tilting motion in the other direction.

This supply takes place on one or two outputs according to the importance and the nature of the correction determined by the comparator/computer. Two of the reducers 15*a*, 15*b*, 15*c* thus supplied produce a distribution of the pressures within the jacks such that a torque in opposition to the tilting torque of the platen 2 is developed, thus ensuring general parallelism as well as deformation of this platen which is capable of optimizing the parallelism of the opposite faces of said platen 2 and of the stationary platen 1.

Figure 4:
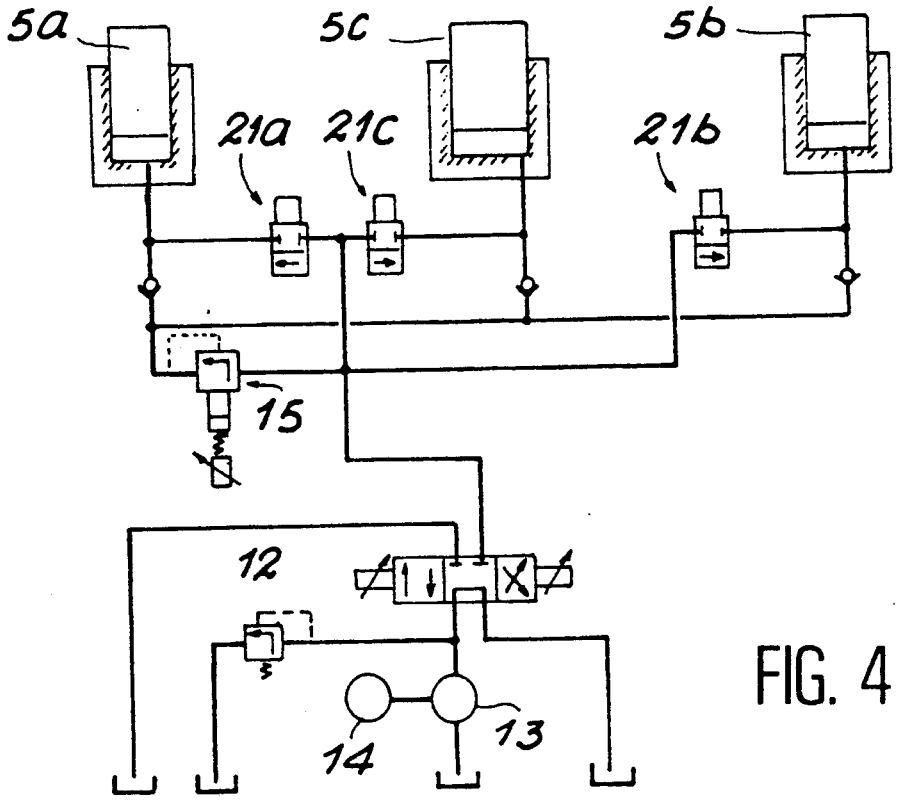

As already indicated, FIG. 4 illustrates another form of construction of the hydraulic control circuit of the present bending press. This form of construction differs from the preceding embodiment in the fact that provision is made for only one pressure reducer designated by the general reference 15.

However, the hydraulic control circuit of the three jacks 5*a*, 5*b* and 5*c* is so arranged as to ensure the possibility of applying to each jack either the normal pressure derived from the pump 13 or a reduced pressure, the value of which is determined by the single reducer 15. To this end, provision is made for three connecting valves 21*a*, 21*b* and 21*c*. Each valve is associated with one of the jacks and makes it possible to apply thereto either the normal pressure or the reduced pressure determined by the reducer 15.

In point of fact, these three connecting valves 21*a*, 21*b* and 21*c* are connected to the comparator-computer as is the case with the pressure reducer 15. Thus, in the event of appearance of a tilting torque, this comparator-computer supplies simultaneously the pressure reducer 15 and two of the valves 21*a*, 21*b*, 21*c* in order to cause a reduction in pressure in the central jack and the working jack located on the side opposite to that on which the eccentric load is applied. This permits the development of an opposing torque which counterbalances the tilting torque and restores general parallelism.

Moreover, the device for detecting the appearance of a tilting torque on the movable lower platen could be constructed differently from the design which is contemplated in the two examples described earlier and which involves monitoring of a difference in displacement of one end of the movable platen with respect to the other. It would in fact be possible to make use of a detection system comprising a number of strain gages suitably disposed in order to detect differences in the forces exerted on the two portions of the movable platen. The strain gages thus provided would in that case be connected to a comparator/ computer circuit which makes it possible to determine both the appearance of a difference between the forces exerted and the direction of this difference.

In regard to the pressure reducing units, they could also be designed differently on condition that they permit a reduction in pressure, not in a general manner for all the working jacks of the movable lower platen but for each of these jacks taken separately or for a number of jacks.

The present invention thus makes it possible to retain the structure of machines provided with a single pressure source, a single distribution for the control of movements and at least three working jacks, at least one of which is placed at the center. This result is achieved under the general conditions of mechanical construction of these machines while at the same time permitting centered or eccentric work under conditions which retain general parallelism and optimization of parallelism of the opposite faces of the upper and lower platens.

I claim:

1. A bending press for deformation of metals in sheet form, comprising a stationary upper platen (1) and a movable lower platen (2) actuated by at least three hydraulic jacks (5*a*, 5*b*, 5*c*) two of which are placed near the lateral ends of the movable platen (2) and at least one of which is placed at the center along a vertical axis of the lower platen (2), the jacks (5*a*, 5*b*, 5*c*) being supplied from a hydraulic circuit comprising a pump (13) driven by a motor (14), a single directional distributor (12) being connected to said jacks (5*a*, 5*b*, 5*c*) via pressure control means (15*a*, 15*b*, 15*c*; 15) for controlling the upward and downward movements of the movable platen (2), a detection device (16*a*, 16*b*) for detecting the presence of any tilting torque on the movable platen (2), and a comparator and computer system (24) connected to the detection device (16*a*, 16*b*) and having outputs (A, B, C) for controlling the pressure control means (15*a*, 15*b*, 15*c*; 15) as a function of the detected tilting torque, the comparator and computer system further including an input (E) for permitting the introduction of additional data defining variations in general work conditions, said comparator and computer system being capable of producing a continuous reduction of the pressure exerted on the jack (5*a* or 5*b*) located on the side opposite to the direction of the tilting torque, and also on the jack (5*c*) located at the center, so as to produce an opposing torque which is a function of a synthesis of the data received from the detection device (16*a*, 16*b*) and of the additional data introduced via the input (E), said opposing torque being capable of counterbalancing the tilting torque in a continuous and proportional manner, thus guaranteeing overall parallelism and of ensuring a constant parallel relationship between work zones of opposite edges of the platens (1, 2) to about the same extent as these work zones undergo deformation during operation.

2. A bending press according to claim 1, wherein the pressure control means comprise as many proportional pressure reducers (15*a*, 15*b*, 15*c*) as there are jacks (5*a*, 5*b*, 5*c*) actuating the movable lower platen (2), and wherein each reducer is associated with a single jack.

* * * * *

UNITED STATES PATENT AND TRADEMARK OFFICE

CERTIFICATE OF CORRECTION

PATENT NO. : 5,243,902

DATED : September 14, 1993

INVENTOR(S) : Jean PLAZENET

It is certified that error appears in the above—identified patent and that said Letters Patent is hereby corrected as shown below:

On the title page, correct Item [73] Assignee as follows:

--[73] Assignees: Amada S.A., Tremblay, France;

Amada Co, Kanagawa, Japan.--

Signed and Sealed this

Thirty-first Day of May, 1994

Bruce Lehman

*Attest:*

BRUCE LEHMAN

*Attesting Officer*

*Commissioner of Patents and Trademarks*